US009214141B2

(12) United States Patent
McNutt

(10) Patent No.: US 9,214,141 B2
(45) Date of Patent: Dec. 15, 2015

(54) STAND AND CRADLE FOR DOUBLE BASS AND CELLO

(71) Applicant: Dennis McNutt, Costa Mesa, CA (US)

(72) Inventor: Dennis McNutt, Costa Mesa, CA (US)

( * ) Notice: Subject to any disclaimer, the term of this patent is extended or adjusted under 35 U.S.C. 154(b) by 392 days.

(21) Appl. No.: 13/848,566

(22) Filed: Mar. 21, 2013

(65) Prior Publication Data

US 2013/0255472 A1 Oct. 3, 2013

Related U.S. Application Data

(60) Provisional application No. 61/617,360, filed on Mar. 29, 2012.

(51) Int. Cl.
*G10G 5/00* (2006.01)

(52) U.S. Cl.
CPC ..... *G10G 5/00* (2013.01)

(58) Field of Classification Search
CPC ..... G10G 5/005; G10G 5/00; G10G 7/005; G10D 3/00; G10D 13/026; G10D 7/10; G10D 9/00; F16M 11/041; F16M 13/00; F16M 11/125
USPC ..... 84/327, 329, 453
See application file for complete search history.

(56) References Cited

U.S. PATENT DOCUMENTS

2012/0144974 A1* 6/2012 May ..... 84/387 A
2012/0318118 A1* 12/2012 Miyajima ..... 84/421

* cited by examiner

*Primary Examiner* — Kimberly Lockett
(74) *Attorney, Agent, or Firm* — Roy A. Ekstrand

(57) ABSTRACT

A stand and cradle suitable for resting a bass or cello instrument upon a floor includes an angled base forming a back support and C-bout support upon which a bass or cello may be rested. The base is further supported by a pivotally coupled angled support which maintains the angle of incline of the base. In one embodiment, a pair of generally planar wood members are used to fabricated the base and angled support. In an alternative embodiment, the base is formed of a pair of tubular legs pivotally joined to together with a pivotally secured angle support also formed of a tubular member. In each embodiment, the cradle and base support is foldable to a collapsed configuration for easy storage and transport.

14 Claims, 8 Drawing Sheets

STAND AND CRADLE FOR DOUBLE BASS AND CELLO

CROSS REFERENCE TO RELATED APPLICATION

This application claims benefit of and priority under 35 U.S.C. 119(e) of U.S. Provisional Patent Application No. 61/617,360, entitled STAND AND CRADLE FOR DOUBLE BASS AND CELLO, filed Mar. 29, 2012 in the name of Dennis McNutt, the disclosure of which is incorporated herein by reference.

FIELD OF THE INVENTION

This invention relates generally to musical instrument stands used during periods of non-use to support a musical instrument. This invention relates more specifically to musical instrument stands suitable for supporting a double bass or cello instrument during non-use in a somewhat inclined standing position.

BACKGROUND OF THE INVENTION

In many musical environments in which a band, orchestra, combo or other group of musicians perform, the need often arises for some musicians to be able to put aside their respective instruments at a location near to them in the playing environment. In some venues, performers and musicians need to change instruments and often move about upon the stage or within the orchestra pit or other environment. Typically, the space allotted to musicians in such environments is extremely crowded. For musicians playing smaller instruments such as horns, reed instruments or the like, the need to put an instrument aside need not create a significant problem. For other musicians, however, playing larger instruments, the environment simply does not permit the larger instruments to be laid upon the floor area near the musician.

One of the most difficult types of instruments to put aside during periods of non-use in proximity to the musician is the type of instrument typified by double bass or cellos. Double basses and cellos are familiar in the musical environment and comprise extremely popular instruments. In essence, double basses and cellos generally resemble violins in their overall shape but are substantially larger. A typical bass may have a body portion exceeding fifty inches in length and supporting an end-pin extending the bass overall length to seventy-two inches. Similarly, cellos typically include a body portion having a length of twenty-seven inches within an overall length including the end-pin of forty-seven inches. In addition to their extended lengths, double basses and cellos define relatively broad body portions which are formed of a relatively fragile hollow wood construction.

Notwithstanding the large volume, size and fragile construction which characterize double basses and cellos, musicians often resort to simply laying the instrument upon the floor surface near the musician during periods of non-use. Laying such large volume fragile instruments upon the floor area of a crowded stage or orchestra pit raises substantial risk of individuals moving about, tripping over or falling upon such instruments. This, of course, risks injury to persons moving about and risks damage to the fragile construction of the bass or cello instruments.

Recognizing the difficulties and risks associated with this practice of laying large body instruments such as double basses and cellos upon the floor surface near musicians, practitioners in the art have endeavored to provide a suitable type of stand or support to be used in supporting such instruments in a vertical or near vertical attitude. Such devices have included stands which are formed of a pair of parallel base plates joined by spaced apart ribs intended to receive and cradle the lower end of a double bass or cello. Additionally, apparatus have been provided in which a pair of base members are joined by upwardly and outwardly angled planar members forming a "V" shaped cradle also intended to receive the lower end of a double bass or cello. Other stands and support apparatus have been provided in which a small chair-like device having a padded upper portion receives the lower end of the instrument body allowing the C-bout to rest on the padded surface. Still other apparatus have provided a cradle-like base together with a vertically extending post or mast. The upper end of the mast supports a yoke suitably configured to receive the neck portion of a double base or cello.

There arises therefore a critical and unresolved need in the art for an effective and convenient stand or cradle for large volume instruments such as double basses or cellos which facilitate the temporary setting aside of such instruments near the musician without unduly encumbering floor space or creating a risk to persons moving about in the stage or orchestra pit environment.

SUMMARY OF THE INVENTION

In accordance with the present invention, there is provided a musical instrument stand and cradle for supporting a bass or cello having a back and C-bout, the stand and cradle comprising: a base support member supporting a back support and C-bout support; and angled support pivotally joined to the base member and extending downwardly therefrom, the angled support movable between a closed position against the base member and an open position angled away from said base member; and means for fixing the angled member in the open position to receive a bass or cello musical instrument, the C-bout support received within a C-bout and said back support having a back supported against it.

To briefly summarize the disclosed embodiments of the present invention stand and cradle for double basses and cellos includes a generally planar bass member supporting a cradle portion having a defined receiving and support area for contacting the double bass or cello to be supported. The cradle is preferably padded with a protective padding to avoid damage to the contacting surface of the double bass or cello being supported. In its preferred fabrication, the position of the cradle is adjustable upon the bass member to vary the angle at which the instrument is supported. The combined structure of the bass and cradle are supported at a desired angle by a support arm which is preferably pivotally secured to the bass member and which extends downwardly therefrom. A flexible link such as a belt, chain or rigid restraint is joined to the bass member and support arm near the bottom edges thereof. The length of belt or chain is adjustable to vary the angle between the support arm and the bass member. In operation, the upward extension of the cradle is selected to accommodate the size of the double bass or cello being supported while the angle of the support arm is adjusted to provide the angle of inclination for the double bass or cello. In the anticipated use of the present invention stand and cradle, the double bass or cello is rested upon the cradle portion such that the cradle portion extends into a C-bout at the waist of the instrument. In further accordance with the anticipated use of the present invention stand and cradle, the padded portions of the cradle contact the C-bout on one side of the instrument near the upper violin corner of the instrument body. The present invention stand and cradle may be fabricated of a variety of materials as desired. However, it has been found attractive and advantageous in many environments to fabricate the stand and cradle of a suitable wood material. In an alternate embodiment of the present invention stand and cradle, a fully collapsible stand and cradle is provided by a trio of generally tubular members joined near their respective upper ends. The lower ends of each tubular member are joined to an adjacent tubular member by a rigid restraint. The attachment of the upper ends of the tubular members is a pivotal attachment allowing the tubular members to be folded together in a collapsed configuration. The instrument cradle is provided by an upward extension of one of the tubular members beyond the junction portion and an angled extension of a tubular member upwardly and outwardly from the junction portion. A suitable padding is supported upon the upward and angled extensions to avoid damage to the instrument being supported thereon. Once again, in the anticipated use of the present invention stand and cradle, the padded portions of the cradle contact the instrument body within a C-bout of the body near the upper violin corner thereof.

In this fashion, the large volume instrument such as a double bass or cello is securely and conveniently supported in an upwardly angled position avoiding the cluttering of the area floor surface and facilitates placing the instrument at rest and raising it into playing position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention stand and cradle for double bass and cello is configured to facilitate the inclined positioning of a double bass or cello upon the end-pin or lower bout thereof. The inventive stand and cradle includes an inclined support member having a padded cradle formed on the upper end thereof. The inclined cradle and base supporting the cradle are further supported by an angled support which in its preferred form comprises a general planar member which is hinged to the bass and which is spaced from the bass by a flexible restraint such as small chain or cord or by a rigid restraint. The belt, small chain or cord is secured between the lower end of the base member and the lower end of the angled support. The length of the flexible link determines the angle of inclination of the base member and cradle supported thereby. The cradle is configured to be received within a C-bout of the instrument as the instrument rests against the stand and cradle. The configuration of the padded cradle provides a support extending across the rear surface of the instrument and a somewhat hooked retaining member which extends around the front edge of the C-bout proximate the upper violin corner of the C-bout. In an alternate embodiment, a trio of generally elongated preferably tubular type support members are mutually joined at a junction point by a plurality of pivotal attachments. The lower ends of the tubular members preferably include a rubber or plastic foot. The tubular members are joined to their respective adjacent tubular members by rigid restraints. The lengths of the rigid restraints determine the spread or angle of the tubular members as they assume a triangular shape support base. Above the junction of the tubular members, a first element extends upwardly and rearwardly to support the back surface of the instrument. A second support member extends forwardly and is upwardly hooked to be received within the C-bout of the supported instrument. Both the angular member and the hook shaped member are preferably padded to avoid damage to the supported instrument. The stand and cradle provided in this embodiment receives and secures the supported instrument in much the same manner as the above-described embodiment. Additionally, the pivotal attachments between tubular members facilitates the collapse of this embodiment of the inventive stand and cradle allowing for easy transport and carrying.

Figure 1:
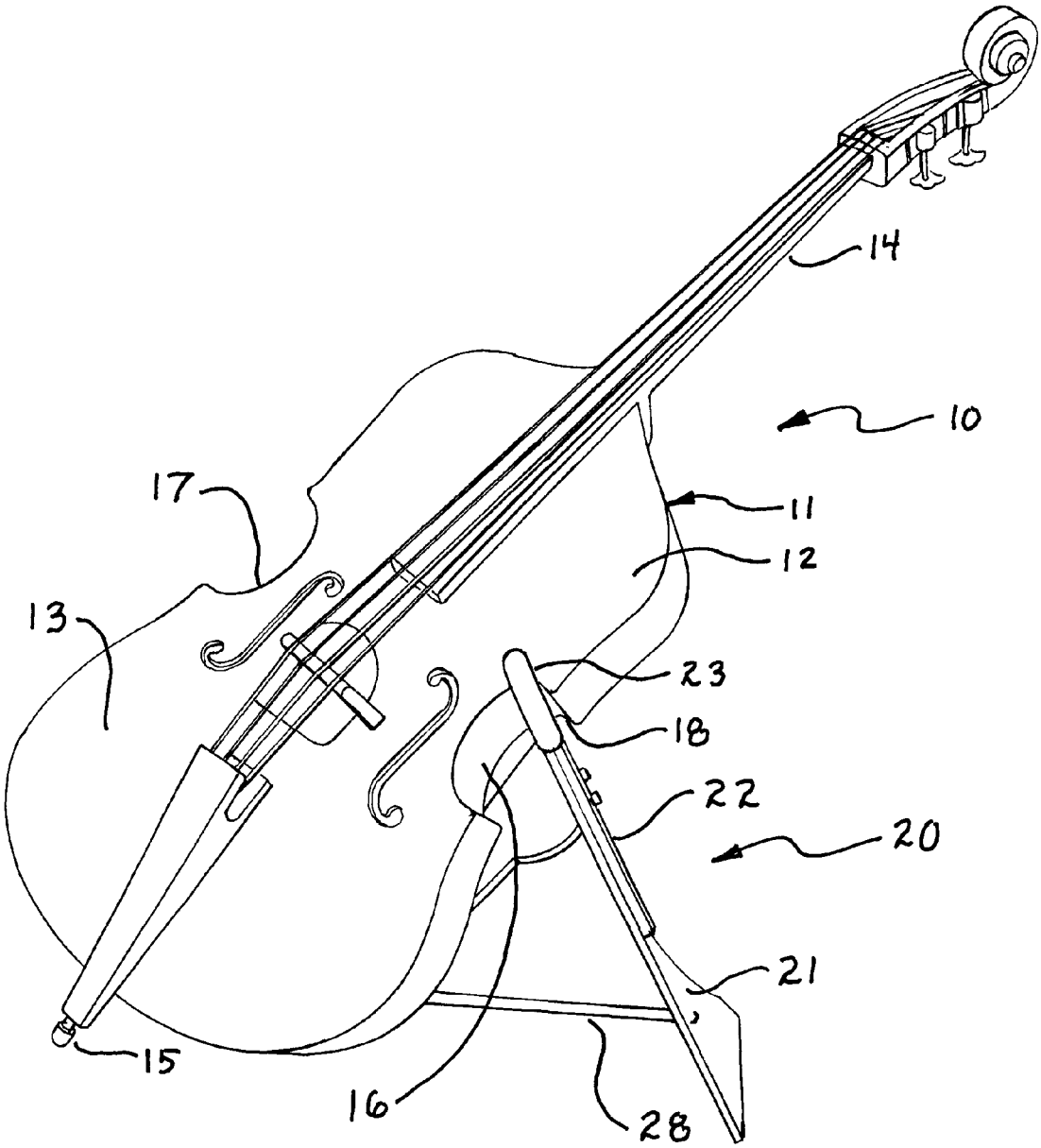
FIG. 1 sets forth a perspective view of a stand and cradle for double bass and cello constructed in accordance with the present invention supporting a typical double bass.

More specifically, FIG. 1 sets forth a front perspective view of a typical double bass instrument generally referenced by numeral 10 and supported within a stand and cradle constructed in accordance with the present invention and generally referenced by numeral 20. It will be noted that double bass instruments are often simply referred to as "basses". Thus, as used herein, the terms "double bass" and "bass" are interchangeable. Bass 10 is fabricated in accordance with conventional fabrication techniques and thus includes a generally hollow wooden body 11 formed of a upper bout 12, a lower bout 13 and a pair of inwardly extending C-bouts 16 and 17. C-bouts 16 and 17 also define which is generally referred to as the "waist" of body 11. Also in accordance with conventional fabrication techniques, bass 10 includes a neck 14 extending upwardly from upper bout 12 and an end-pin 15 extending downwardly from lower bout 13. C-bout 16 further defines a pair of violin corners including upper violin corner 18. As is well known, body 11 of bass 10 is formed of a relatively thin and therefore somewhat fragile wooden material carefully selected and shaped to provide the desired acoustic characteristics of the bass. Accordingly, it is recognized that body 11 in particular of bass 10 is substantially fragile and readily damaged should an individual step upon, trip over or fall upon a bass body, or if bass 10 should fall over. It will also be noted that the descriptions the present invention stand and cradle set forth in connection with its support of bass 10 apply equally well and are equally applicable to a cello instrument. Additionally, other differently shaped instruments having similar needs of cradle support within a bandstand, stage or orchestra pit area will be understood to be able to benefit from the present invention stand and cradle. Thus, while the present invention stand and cradle is specifically configured with cellos and double basses in mind, its inventive characteristics and use may apply readily to other instruments such as electric guitars, basses and acoustic guitars without departing from the spirit and scope of the present invention.

Stand and cradle 20 is formed of a planar base member 21 supporting a generally planar cradle member 22. As is better seen in FIG. 2, cradle member 22 defines a back support 24 (seen in FIG. 2), a C-bout support 23 and a clearance notch 26 (seen in FIG. 2) therebetween. It will also be equally apparent by reference to FIG. 2 that back support 24 and C-bout support 23 are padded to avoid damage to the instrument surface when the instrument is supported within cradle member 22.

Figure 2:
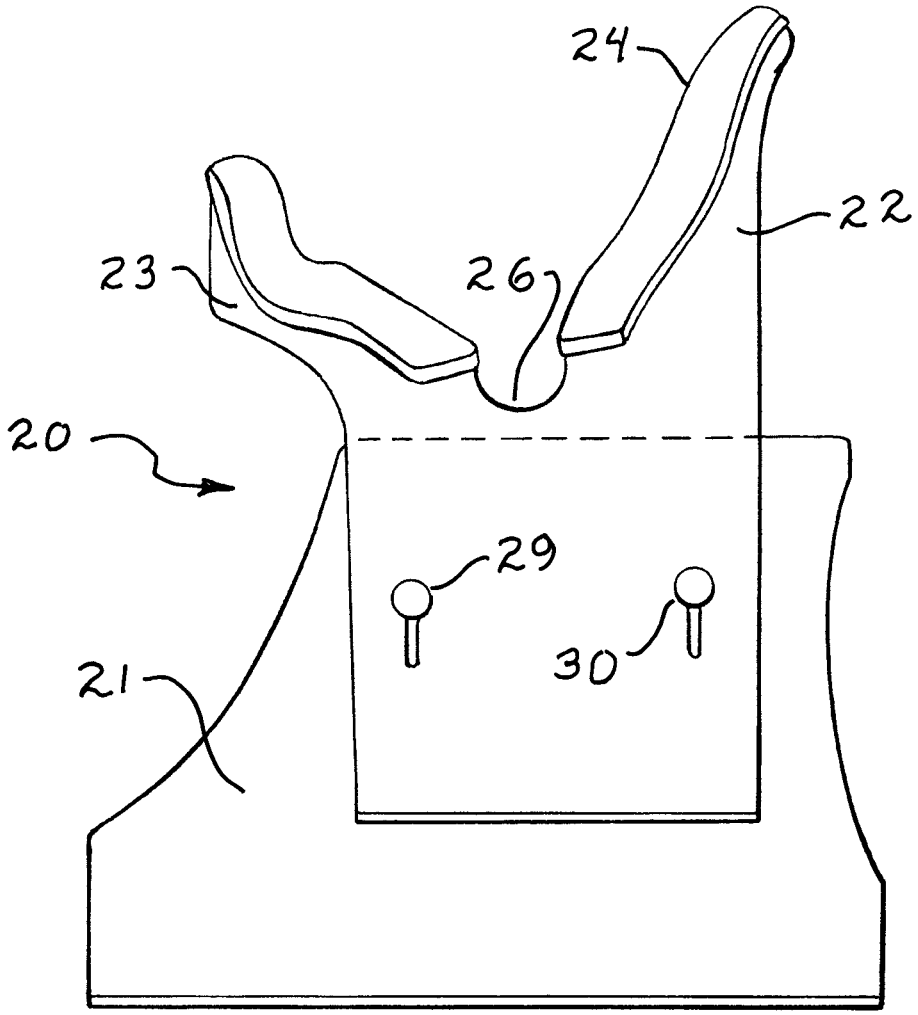
FIG. 2 sets forth a front view of the present invention stand and cradle for double bass and cello.
Figure 3:
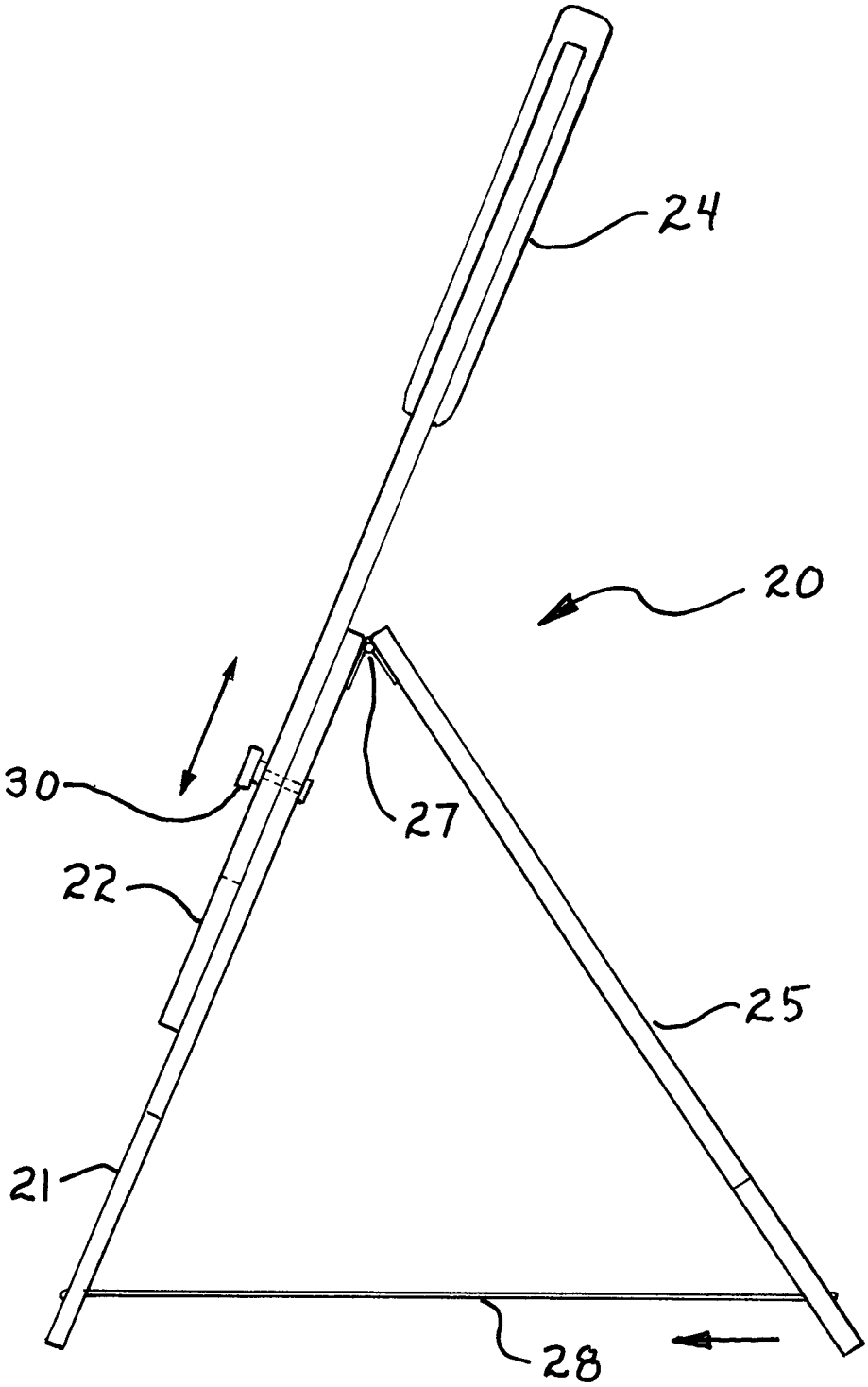
FIG. 3 sets forth a right side view of the present invention stand and cradle for double bass and cello.

Returning to FIG. 1, it will be seen that stand and cradle 20 further includes a generally planar angled support 25 which, as is better seen in FIG. 3, is pivotally joined to the undersurface of base member 21 by an elongated hinge 27. Hinge 27 is fabricated in accordance with conventional fabrication techniques with the essential characteristic of providing pivotal movement between angled support 25 and base member 21. A flexible link 28 is joined to base 21 and angled support 25 at the lower portions thereof. As mentioned above, flexible link 28 is fabricated of a suitable flexible material such as a belt, cord or small chain with the essential characteristic being flexible to enable folding angled support 25 against base member 21 and cradle member 22 to compact stand and cradle 20 for easy transport and storage. In the application of stand and cradle 20 shown in FIG. 1, bass 10 is supported at end-pin 15 upon the floor surface and is inclined upwardly and rearwardly to position C-bout 18 within cradle 22. More specifically, C-bout 16 is received between back support 24 (seen in FIG. 2) and the upper portion of C-bout support 23. When so positioned, the extension of violin corner 18 across C-bout support 23 securely maintains bass 10 in its supported position upon stand and cradle 20. It will be apparent to those skilled in the art that stand and cradle 20 is adjustable to change the angle of inclination and height of the cradle by which bass 10 is supported. Additionally, it will be recalled that end-pin 15 is often adjusted by users to different lengths to suit the particular physical characteristics and reach of the musician. Accordingly, the extension position of end-pin 15 also in part determines the angle of support for bass 10. A more upright angle may be obtained by shortening link 28 and by adjusting the fixed position of cradle member 22 in its attachment to base member 21. Thus, the angle of inclination may be moved toward a more upright angle by shortening link 28 and/or by moving cradle 22 upwardly in its attachment to base 21. In this manner, the desired angle and height for support of bass 10 is achieved.

As will be recalled, FIG. 1 is described as supporting a bass 10. As is also described above, stand 20 is equally well suited to supporting the smaller bodied but generally similarly shaped instrument known as a cello. Thus, the support of a cello in place of bass 10 utilizing stand and cradle 20 will be understood to be readily available. The reduced size of a cello instrument is accommodated by adjusting the instrument end-pin extension as well as adjusting the position of cradle member 22 upon base 21 and/or adjusting the length of link 28. Additionally, however, it will be understood that a smaller stand and cradle generally scaled down from stand and cradle 20 may be fabricated in accordance with the present invention.

FIG. 2 sets forth a front view of stand and cradle 20 having bass 10 removed from support therein. As described above, stand and cradle 20 is preferably formed of a wood or similar material and includes a generally planar base 21 having a cradle member 22 secured thereto utilizing conventional fasteners 29 and 30 or the like. Fasteners 29 and 30 cooperate with slots 31 and 32 respectively to allow the extension of cradle member 22, if desired. As is also described above, cradle member 22 defines a back support 24 and a C-bout support 23. A clearance notch 26 is formed between back support 24 and C-bout support 23. Back support 24 extends along the back surface of bass 10 and is therefore padded with a soft resilient material. Similarly, C-bout support 23 extends through C-bout 16 (seen in FIG. 1) of bass 10 and is hooked to extend upwardly therefrom thereby captivating body 11 of bass 10 (also shown in FIG. 1). C-bout support 23 is also padded with a soft resilient material to avoid damage to the surface of the bass body. Clearance notch 26 provides a space into which the back edge of the C-bout is able to extend thereby avoiding damage to the bass body.

FIG. 3 sets forth a side view of stand and cradle 20 once again configured in its instrument receiving assembled position. Thus, as is described above, stand and cradle 20 includes a generally planar base member 21 supporting a cradle member 22. Cradle 22 supports a C-bout support 23 (seen in FIG. 2) and a back support 24. An angled support 25 is pivotally secured to base member 21 by an elongated hinge 27. A flexible link 28 extends between the lower ends of base member 21 and angled support 25. It will be apparent from examining FIG. 3 that the length of flexible link 28 readily adjusts the inclination of base member 21 and cradle member 22 and thus provides the above mentioned adjustment. It will be equally apparent to those skilled in the art from examining FIG. 3 that the above-described adjustment of the position of attachment between base member 21 and cradle member 22 facilitates a height adjustment of stand and cradle 20 which in turn further accommodates differently sized instruments and produces different inclinations of supported instruments. It will be noted that, as an alternative, cradle member 22 and base member 21 may be formed of a single planar member.

In the configuration shown in FIG. 3, stand and cradle 20 is assembled to receive and support a musical instrument such as a cello or double bass. This position is characterized by the angled position of angled support 25 with respect to base member 21 and, while not seen in FIG. 3, it will be understood that flexible link 28 is drawn relatively tightly as angled support 25 and base member 21 are angled to separate the respective lower ends thereof. It will be apparent to those skilled in the art that stand and cradle 20 is readily configured in its collapsed configuration by simply lifting stand and cradle 20 and pivoting angled support 25 toward base member 21 to collapse stand and cradle 20 to a flattened configuration convenient for travel or storage.

Figure 4:
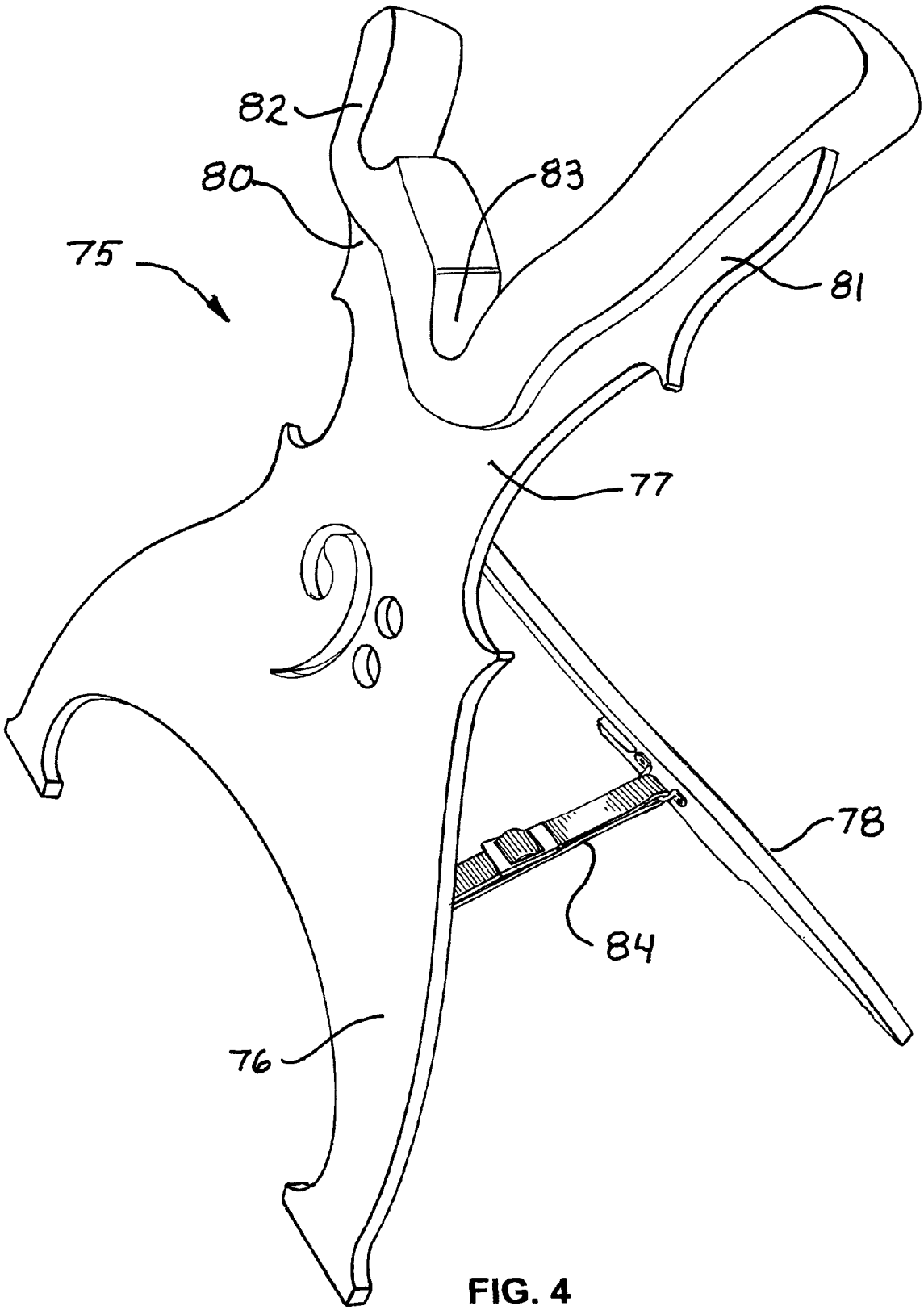
FIG. 4 sets forth a perspective view of an alternate embodiment of the present invention stand and cradle for double bass and cello.

FIG. 4 sets forth a perspective view of a stand and cradle for double bass and cello stand and cradle for double base and cello constructed in accordance with the present invention and generally referenced by numeral 75. Stand and cradle 75 includes a generally planar base member 76 configured for solid firm support upon a floor surface. Planar base member 76 further includes a planar cradle member 77 extending upwardly therefrom. In the preferred fabrication of the embodiment of the present invention shown in FIG. 4, planar base member 76 and planar cradle member 77 are preferably formed of a single relatively thick material such as wood, high quality plywood, hardwood or the like. It will be apparent however that other materials which provide sufficient weight and rigidity may be used in fabricating planar base member 76 and planar cradle member 77. Planar cradle member 77 further includes an upwardly and outwardly extending back support portion 81 together with a laterally extending C-bout support 80. In the preferred fabrication of the present invention, C-bout support 80 and back support 81 are covered with a cushioning protective padding 82. While a variety of materials may be utilized for protective padding 82, in the preferred embodiment of stand and cradle 75, padding 82 is formed of a molded plastic cushioning material, foam rubber or the like. Padding 82 is shown formed of a single unitary pad conformed to fit C-bout 80 and back support 81. However, it will be apparent to those skilled in the art that multiple padding sections may be utilized if preferred. A clearance notch 83 is formed at the base of back support 81 and C-bout support 83. As mentioned above, and with temporary return to FIG. 2, a clearance notch such as notch 26 is provided to avoid wear upon the edge portion of the cello or bass resting within the present invention stand and cradle. Returning to FIG. 4, clearance notch 83 provides this function.

Figure 5:
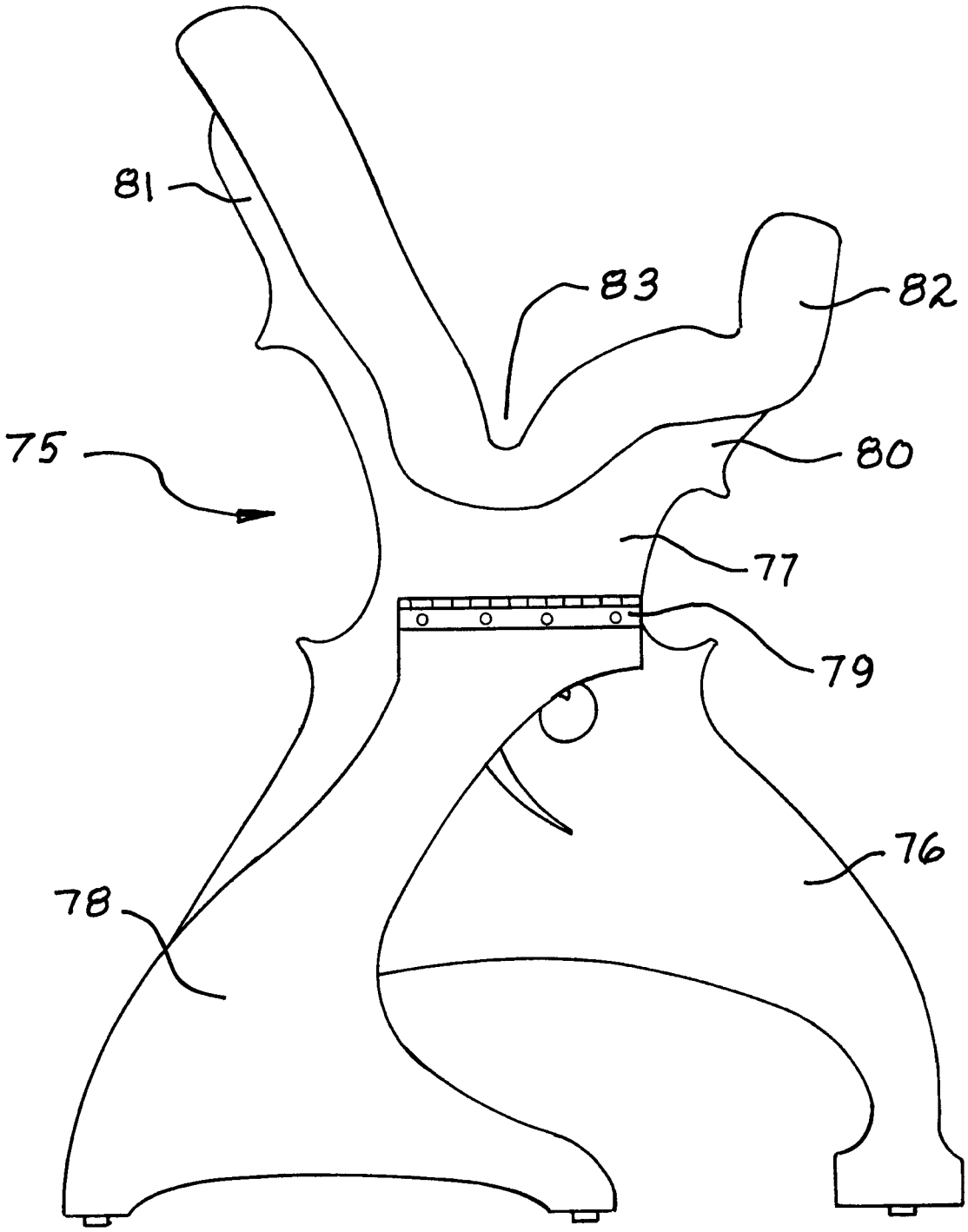
FIG. 5 sets forth a rear view of the alternate embodiment shown in FIG. 4.

Stand and cradle 75 further includes an angled support 78 which, as is better seen in FIG. 5, is pivotally joined to base member 76 and cradle member 77 by an elongated hinge 79. The angle position assumed by angled support 78 with respect to planar base member 76 and planar cradle member 77 is established by a flexible adjustable belt 84 coupled between base member 76 and angled support 78. Adjustable belt 84 is adjusted in length to establish the desired angle between angled support 78 and planar base 76 which in turn establishes the angle of incline relative to the supporting floor surface provided by base member 76 and cradle member 77. It will be apparent that this angle also influences the height of the cradle and the stable angle at which a bass or cello instrument will rest securely against stand and cradle 75.

In similar fashion to stand and cradle 10 set forth above in FIGS. 1 through 3, stand and cradle 75 may be folded or collapsed for easier transport and storage.

FIG. 5 sets forth a rear view of stand and cradle 75 in its open configuration. Thus, as described above, stand and cradle 75 includes a generally planar base member 76 and planar cradle member 77 preferably formed of a single unitary piece of wood or the like. As is also described above, planar member 77 includes a back support 81 and a C-bout support 80. A clearance notch 83 is formed between C-bout support 80 and back support 81. A protective padding 82 covers C-bout support 80 and back support 81. Stand and cradle 75 further includes an angled support 78 pivotally joined to planar base member 76 by a hinge 79. As mentioned above, hinge 79 provides the capability for adjusting the angle of planar base 76 and cradle member 77 by adjusting belt 84. Additionally hinge 79 facilitates folding angled support 78 against planar base member 76 to configure stand and cradle 75 in a flat folded configuration for easy transport and storage.

Figure 6:
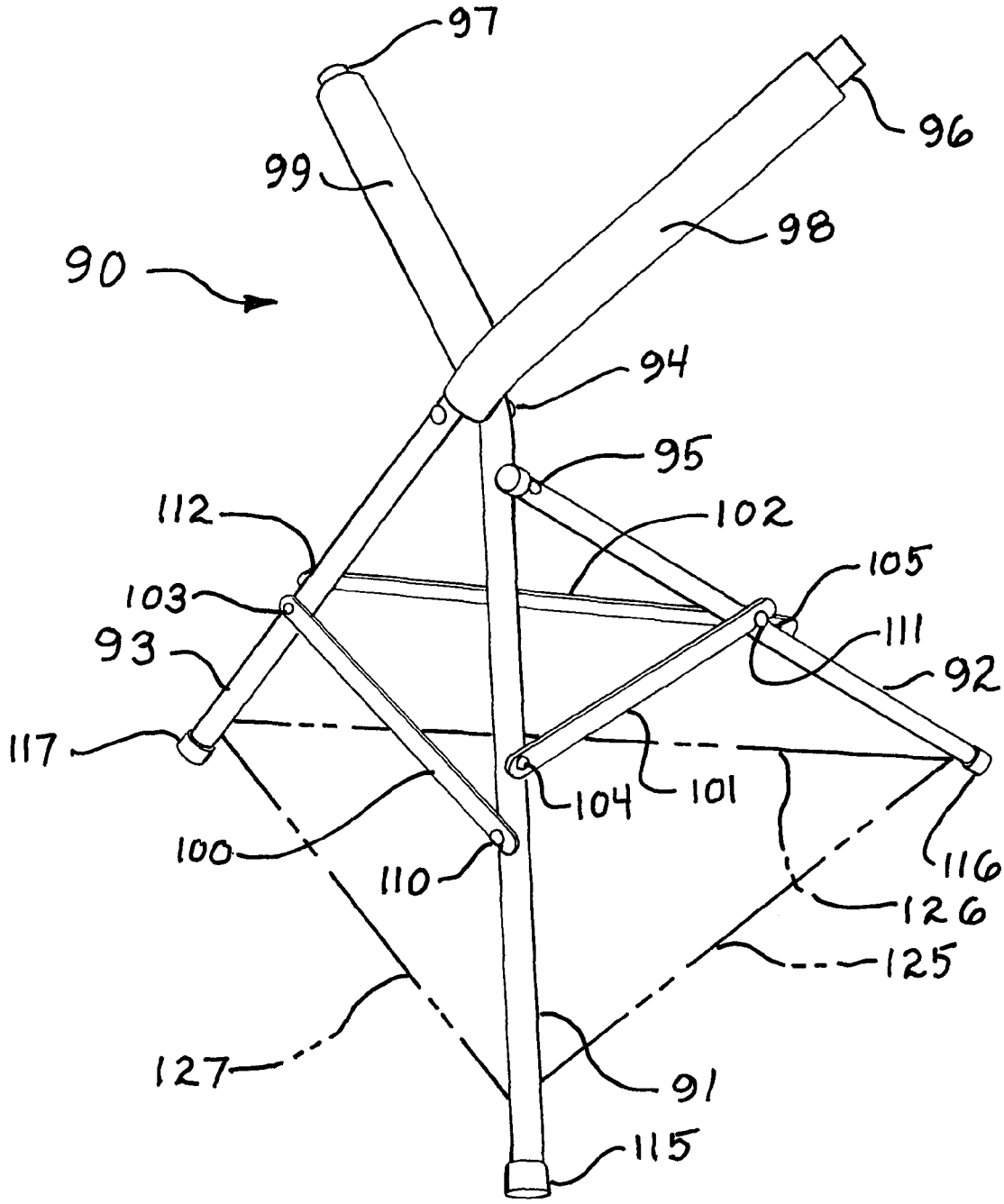
FIG. 6 sets forth a perspective view of a further alternate embodiment of the present invention stand and cradle for double bass and cello.

FIG. 6 sets forth a perspective view of a still further alternate embodiment of the present invention stand and cradle for double bass and cello generally referenced by numeral 90. Stand and cradle 90 is fabricated to provide the above-described base and cello support while providing additional collapsibility or compact configuration for storage and transport. Thus, in the fully open configuration shown in FIG. 6, stand and cradle 90 is configured to receive a bass or cello instrument rested upon the stand and cradle such that the instrument C-bout receives C-bout support 97 and such that the instrument back rests upon back support 96 in much the same manner as the above-described embodiments. Similarly, an angle leg 92 provides the angled support utilized in setting the angle of inclination on the base member legs (legs 91 and 93).

More specifically, stand and cradle 90 includes a pair of tubular legs 91 and 93 joined by a pivot pin 94. Legs 91 and 93 further support resilient foot pads 115 and 117. Stand and cradle 90 further includes an angled support leg 92 joined to leg 91 by a pivot pin 95. Angled leg 92 further supports a resilient foot support 116. The upper portion of leg 91 extending beyond pivot pin 94 defines a C-bout support 97 having a resilient pad 99 formed thereon. Similarly, the portion of leg 93 extending beyond pivot pin 94 forms a back support 96 having a resilient pad 98 formed thereon. Stand and cradle 90 further includes a connecting link 100 pivotally secured to leg 93 by a pivot pin 103. Similarly, a connecting link 101 is secured to leg 91 by a pivot pin 104 while a connecting link 102 is secured to leg 92 by a pivot pin 105. Leg 91 further supports a latch pin 110 while leg 92 further supports a latch pin 111 and leg 93 supports a latch pin 112. As can be better seen in FIG. 8, link 100 defines a notch 120 at one end thereof while link 102 defines a notch 121 at one end thereof. While not seen in the Figures, it will be understood that link 101 defines a similar notch in the end thereof.

In the open configuration shown in FIG. 6, legs 91 and 93 are secured by link 100 to form the base member of stand and cradle 90. This secure attachment is provided by the cooperation of notch 120 (seen in FIG. 7) formed in the end of link 100 and received upon latch pin 110. The cooperation of latch pin 110 and end notch 120 of link 100 secures the angular relationship between legs 91 and 93. In similar fashion, link 102 is secured to latch pin 112 supported on leg 93 thereby fixing the angular position between legs 92 and 93. Finally, link 101 secured to latch pin 111 by an end notch (not shown) secures the angular relationship between legs 91 and 92. With legs 91, 92 and 93 thus secured, their respective angle supports form a stable triangle which is secure and reliable in supporting a musical instrument bass or cello. Pad 98 upon back support 96 forms a supporting surface for the back of a bass or cello instrument (not shown) while C-bout support 97 and pad 99 are received within the bass or cello (not shown) in a similar support to that set forth above in FIG. 1 for bass or cello 10.

Figure 7:
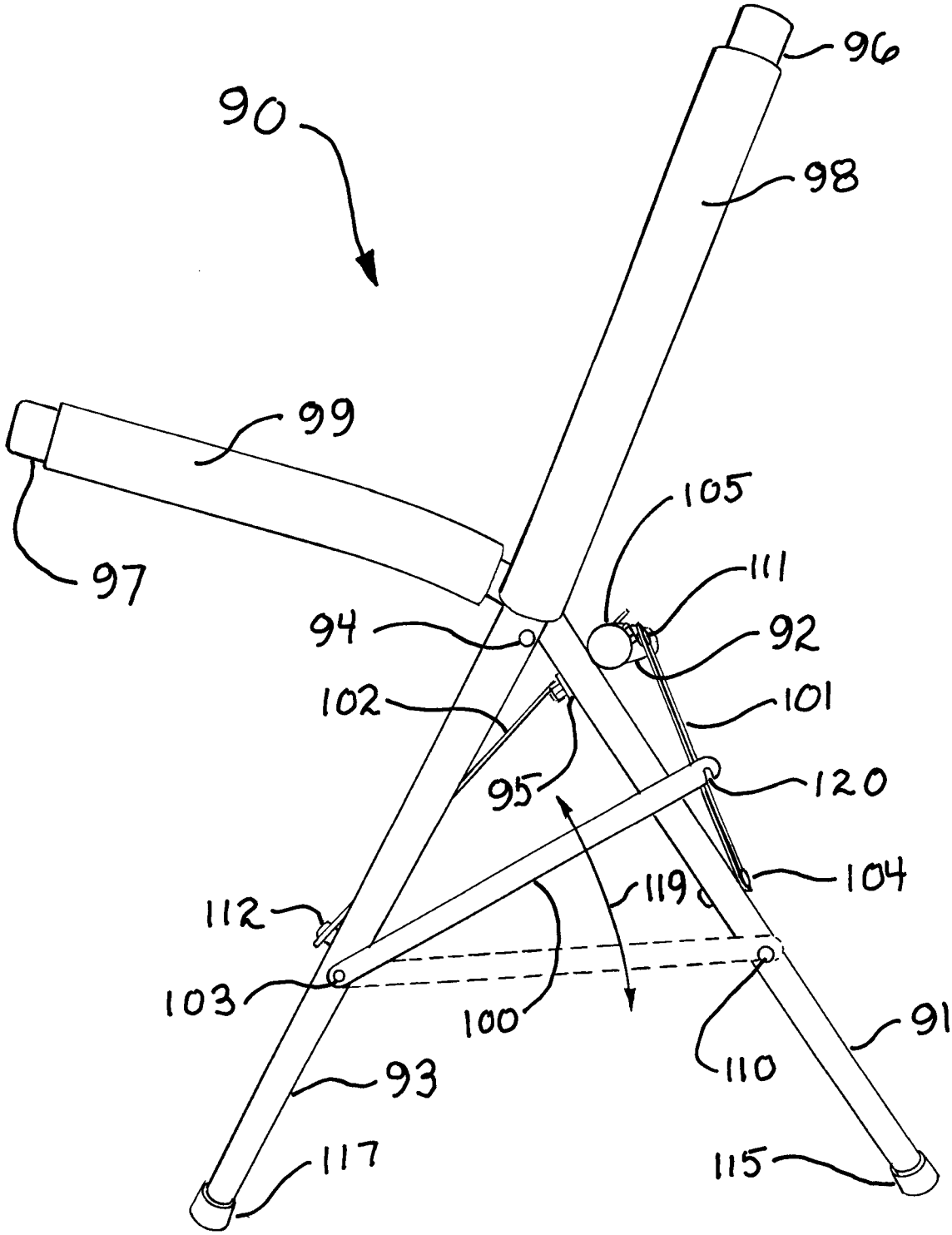
FIG. 7 sets forth a top perspective view of the further alternate embodiment shown in FIG. 6.
Figure 8:
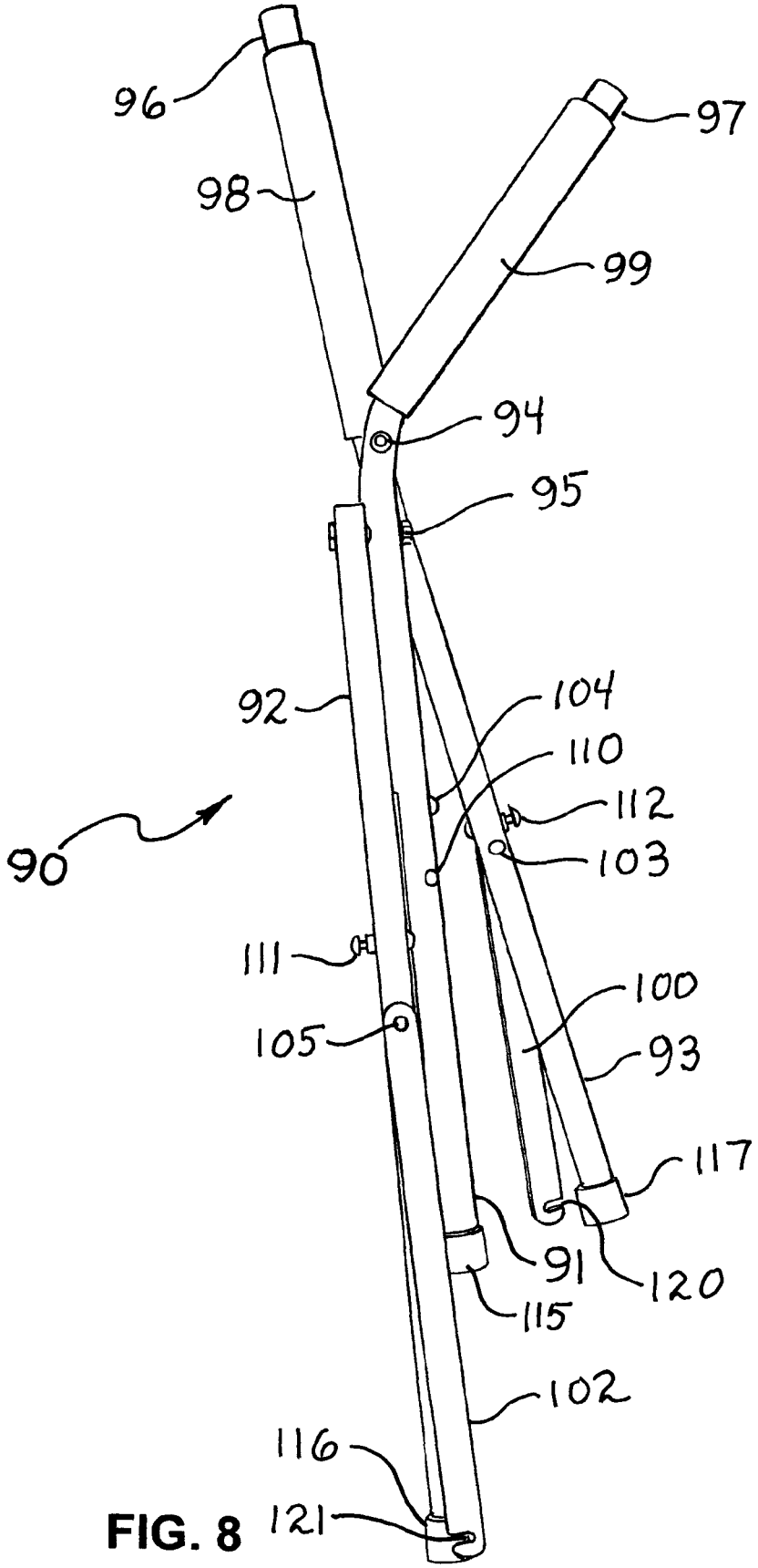
FIG. 8 sets forth a perspective view of the embodiment further alternate embodiment the present invention stand and cradle for double bass and cello shown in FIG. 6 in a folded configuration.

FIG. 7 sets forth a perspective view of stand and cradle 90 at the initial step of folding the stand and cradle to the folded configuration shown in FIG. 8. As can be seen, this initial step involves pivoting link 100 supported on leg 93 upwardly in the manner indicated by arrows 119. It will be apparent that similar pivotal unlatching movements are initiated for links 101 and 102.

More specifically, stand and cradle 90 includes a pair of tubular legs 91 and 93 joined by a pivot pin 94. Legs 91 and 93 further support resilient foot pads 115 and 117. Stand and cradle 90 further includes an angled support leg 92 joined to leg 91 by a pivot pin 95. Angled leg 92 further supports a resilient foot support 116. The upper portion of leg 91 extending beyond pivot pin 94 defines a C-bout support 97 having a resilient pad 99 formed thereon. Similarly, the portion of leg 93 extending beyond pivot pin 94 forms a back support 96 having a resilient pad 98 formed thereon. Stand and cradle 90 further includes a connecting link 100 pivotally secured to leg 93 by a pivot pin 103. Similarly, a connecting link 101 is secured to leg 91 by a pivot pin 104 while a connecting link 102 is secured to leg 92 by a pivot pin 105. Leg 91 further supports a latch pin 110 while leg 92 further supports a latch pin 111 and leg 93 supports a latch pin 112. As can be better seen in FIG. 8, link 100 defines a notch 120 at one end thereof while link 102 defines a notch 121 at one end thereof. While not seen in the Figures, it will be understood that link 101 defines a similar notch in the end thereof.

Upon pivoting link 100 upwardly as indicated by arrows 119, and performing a similar unlatching and pivotal movement of links 101 and 102, the angular relationships between legs 91, 92 and 93 are no longer maintained. Accordingly, legs 91, 92 and 93 may be pivoted about their respective pivots to the folded configuration shown in FIG. 8. Thus, legs 91 and 93 are folded together pivoting about pivot pin 94 while leg 93 is pivoted to generally lie along side leg 91 by pivoting about pivot pin 95. At this point, stand and cradle 90 assumes the folded configuration shown in FIG. 8.

FIG. 8 sets forth a side elevation view of stand and cradle 90 in its folded configuration. As can be seen by examination of FIG. 8, the folded configuration of stand and cradle 90 is completed by pivoting connecting links 100 and 102 generally aligned with legs 93 and 92 respectively. While not seen in the side elevation view of FIG. 8, it will be understood that link 101 is similarly aligned with leg 91.

As described above, stand and cradle 90 includes a trio of supporting legs 91, 92 and 93 pivotally secured by pivot pins 94 and 95. As is also described above, leg 93 forms upwardly extending back support 96 having pad 98 thereon while the upper extension of leg 91 forms C-bout support 97 having pad 99 thereon. In the folded configuration shown, the entire stand and cradle may be situated within a convenient carrying case or may simply held together and carried.

It will be apparent to those skilled in the art that the collapsible embodiment of the present invention stand and cradle is operative in basically the same manner as the above-described embodiments with the difference being found in the use of tubular legs to form the base member and angled member to support the back support and C-bout support utilized in engaging the bass or cello instrument resting upon the stand and cradle. It will be further apparent to those skilled in the art that while a plurality of rigid links (links 100, 101 and 102) are utilized in securing the angular positions between the respective three legs forming the support for stand and cradle 90, other attachment apparatus may be utilized without departing from the spirit and scope of the present invention. For example, a trio of flexible cords or chains shown in FIG. 6 in phantom line depiction and designated as flexible links 125, 126 and 127 may be utilized as an alternative leg position fixing device replacing or supplementing rigid links 100, 101 and 102.

What has been shown is a stand and cradle for double bass and cello which supports either instrument at various angles of inclination which, in most instances, extends between thirty to eighty degrees. The inventive stand and cradle does not require lifting the instrument to insert either the instrument body or end-pin into a receptacle. The inventive stand and cradle accommodates various sizes of instruments and various positions of their end-pins as they are set to accommodate different sizes of players. The instrument is able to lie upon its C-bout partially resting upon its back and sides thus lowering the center of gravity and providing a more stable support. A padded support is provided to avoid damage to the body of the instrument while a relief notch between the back support and C-bout support avoids damage to the instrument body edges. The inventive stand and cradle may be utilized with other instruments such as electric guitars or basses.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A musical instrument stand and cradle for supporting a bass or cello having a back and C-bout, said stand and cradle comprising:

a base member supporting a back support and C-bout support;

an angled support pivotally joined to said base member and extending downwardly therefrom, said angled support movable between a closed position against said base member and an open position angled away from said base member; and means for fixing said angled member in said open position to receive a bass or cello musical instrument, said C-bout support of said base member received within a C-bout of a bass or cello and said back support of said base member having a back of a bass or cello musical instrument supported against said back support of said base member.

2. The stand and cradle set forth in claim 1 wherein said back support and said C-bout support each include a cushioning padding.

3. The stand and cradle set forth in claim 2 wherein said base member includes a cradle member and wherein said back support and said cradle support extend upwardly from said cradle support.

4. The stand and cradle set forth in claim 3 wherein said back support extends generally upwardly and wherein said C-bout support extends upwardly and angles away from said back support.

5. The stand and cradle set forth in claim 4 wherein said cradle member defines a clearance notch between said back support and said C-bout support.

6. The stand and cradle set forth in claim 5 wherein said means for fixing includes a flexible link having opposed ends, one of said ends being attached to said base member and one of said ends being attached to said angled member.

7. The stand and cradle set forth in claim 6 wherein said base member and said cradle member are formed of a single planar member.

8. The stand and cradle set forth in claim 7 wherein said single planar member is formed of wood.

9. The stand and cradle set forth in claim 2 wherein said base member includes:

a first elongated tubular leg having a first foot end and a first upper end forming an angled C-bout support;

a second elongated tubular leg having a second foot end and a second upper end forming an upwardly angled back support;

a first pivot pin pivotally joining said first and second legs at points beneath said C-bout and said back support; and wherein said angled support includes a third elongated tubular leg having a third foot end and a third upper end pivotally joined to said first leg, said first, second and third legs being pivotable between an open configuration forming a triangular based pyramid support for said C-bout support and said back support and a closed configuration in which said first, second and third legs are closer together than said first, second and third legs are in said open configuration.

10. The stand and cradle set forth in claim 9 wherein said means for fixing includes a trio of connecting links connected between said first, second and third legs.

11. The stand and cradle set forth in claim 10 wherein said connecting links are rigid members each pivotally joined to one of said legs at one end and each defining a notch at its remaining end.

12. The stand and cradle set forth in claim 11 wherein each of said legs supports a latch pin, each of said latch pins cooperating with one of said notches in said connecting links to latch said connecting links between said legs.

13. A musical instrument stand and cradle for supporting a bass or cello having a back and C-bout, said stand and cradle comprising:

a generally planar base member and cradle member;

an angled support pivotally joined to said base member, movable between an open position extending downwardly away from said base member and a closed position against said base member;

means for limiting said angled support in said open position to a pre-determined angle;

a back support formed in said base member;

a C-bout support formed in said base member;

a clearance notch formed in said base member, said back support extending upwardly from said clearance notch and said C-bout support extending from said clearance notch forming an angle from said back support.

14. The stand and cradle set forth in claim 13 wherein said angle formed between said back support and said C-bout support is an approximate right angle.

* * * * *